US006843578B1

(12) United States Patent
Cheung

(10) Patent No.: US 6,843,578 B1
(45) Date of Patent: Jan. 18, 2005

(54) ELECTRO-LUMINESCENT FOOTWEAR OR CLOTHING SYSTEM

(76) Inventor: James Cheung, 37-48 78th St., Jackson Heights, NY (US) 11372

( * ) Notice: Subject to any disclaimer, the term of this patent is extended or adjusted under 35 U.S.C. 154(b) by 0 days.

(21) Appl. No.: 10/321,739

(22) Filed: Dec. 17, 2002

(51) Int. Cl.[7] ..... F21V 21/08; F21V 9/16

(52) U.S. Cl. ..... 362/103; 362/84; 362/802; 362/251

(58) Field of Search ..... 362/103, 84, 802, 362/276, 265, 251, 295, 394

(56) References Cited

U.S. PATENT DOCUMENTS

| | | | | |
|---|---|---|---|---|
| 2,572,760 | A | 10/1951 | Rikelman | 36/1 |
| 4,158,922 | A | 6/1979 | Dana, III | 36/137 |
| 5,124,204 | A | 6/1992 | Yamashita et al. | 428/331 |
| 5,500,635 | A | 3/1996 | Mott | 340/323 |
| 5,813,148 | A | 9/1998 | Guerra | 36/137 |
| 5,865,523 | A | 2/1999 | Chien | 362/84 |
| 5,879,069 | A | 3/1999 | Chien | 362/103 |
| 5,903,103 | A | 5/1999 | Garner | 315/76 |
| 5,955,957 | A | 9/1999 | Calabrese et al. | 340/691 |
| 6,112,437 | A | 9/2000 | Lovitt | 36/137 |
| 6,280,045 | B1 | 8/2001 | Anteby et al. | 362/103 |
| 6,354,712 | B1 | 3/2002 | Anteby | 362/103 |

*Primary Examiner*—Alan Cariaso
*Assistant Examiner*—Guiyoung Lee
(74) *Attorney, Agent, or Firm*—Michael I Kroll

(57) ABSTRACT

An illuminated clothing or footwear article system utilizing electro-luminescent light strips and/or LED's, which are randomly illuminated according to the movement of the person wearing said article(s). Illumination control is accomplished by means of a DC to AC converter and various type switches. Such switches include a random pressure switch, a random or controlled sequencer, a orbiter random motion switch or combinations of such switches. Such switching allows for random or sequenced illumination of light strips or LED's based on user movement.

7 Claims, 20 Drawing Sheets

ELECTRO-LUMINESCENT FOOTWEAR OR CLOTHING SYSTEM

BACKGROUND OF THE INVENTION

1. Field of the Invention

The present invention relates generally to illuminated clothing or footwear and, more specifically, to an illuminated clothing or footwear system utilizing electroluminescent (EL) light strips with multiple images which are randomly illuminated according to the movement of the person wearing the footwear by means of a contact switch having multiple contact points that activate circuits to the EL strips during said movement.

2. Description of the Prior Art

There are other adjustable seat devices. Typical of these is U.S. Pat. No. 2,572,760 issued to N. Rikelman on Oct. 23, 1951.

Another patent was issued to A. Dana, III on Jun. 26, 1979 as U.S. Pat. No. 4,158,922. Yet another U.S. Pat. No. 5,124,204 was issued to T Yamashita et al. on Jun. 23, 1992 and still yet another was issued on Mar. 19, 1996 to J. C. Mott as U.S. Pat. No. 5,500,635.

Another patent was issued to Guerra on Sep. 29, 1998 as U.S. Pat. No. 5,813,148. Yet another U.S. Pat. No. 5,865,523 was issued to T. L. Chien on Feb. 2, 1999 and still yet another was issued on Mar. 9, 1999 to T. L. Lu Chien as U.S. Pat. No. 5,879,069. A patent was issued to M. C. Garner on May 11, 1999 as U.S. Pat. No. 5,903,103 and S. Calabrese et al. was issued U.S. Pat. No. 5,955,957 on Sep. 21, 1999. U.S. Pat. No. 6,112,437 was issued on Sep. 5, 2000 to B. Lovitt and on Aug. 28, 2001 E. J. Anteby et al. was issued U.S. Pat. No. 6,280,045. E. J. Anteby was issued U.S. Pat. No. 6,354,712 on Mar. 12, 2002.

U.S. Pat. No. 2,572,760

Inventor: Nathan Rikelman

Issued: Jan. 15, 1948

An illuminated shoe device comprising a body having portions adapted to be extended about a shoe to fix the device thereto, a battery casing portion adapted to receive a battery, said battery casing portion extending transversely of the device, a lamp portion projecting upwardly from the battery casing portion and having a longitudinal opening therein, a lamp bulb fixed within the opening and having an electric terminal, a conductor extending from the lamp bulb to the battery casing portion, a battery within the casing portion having a terminal in engagement with the conductor, a second conductor extending from the opening in the lamp portion of the body to the battery, and means extending from said second conductor for engagement with the lamp bulb terminal periodically as the shoe having the device thereon is moved whereby to cause the light to be blinked.

U.S. Pat. No. 4,158,922

Inventor: Alfred Dana III

Issued: Jun. 26, 1979

A lighted shoe having a solid state oscillator circuit for causing periodic flashing on and off of a light associated with the shoe. A tilt switch may also be associated with the light or lights, and a three-position manual switch provided having one position wherein the light flashes periodically on and off, another position wherein the light is off, and yet another position wherein the tilt switch is inserted in the circuit with the light. The sole and heel may be formed of an integral piece of transparent rigid material, and an e.m.f. source, the circuit, the switch, and the light mounted on and in the integral piece. An AC adaptor is provided having two recharging plugs so that both shoes can be recharged at one time.

U.S. Pat. No. 5,124,204

Inventor: Takuo Yamashita et al.

Issued: Jun. 23, 1992

Disclosed is a thin film EL panel having a high reliability. The thin film El panel is thin, light, and is made at a low cost. The present invention provides in a thin film electroluminescent (EL) panel comprising a light permeable base plate, a thin film EL element formed on the base plate and a moisture-proof sheet covered thereon, an improvement residing in that a moisture-absorption sheet is placed between said thin film EL element and said moisture-proof sheet, and said moisture-absorption sheet comprises an organic polymer sheet with silica gel powder dispersed therein at a certain surface density. The present invention also provides in a thin film electroluminescent (EL) panel comprising a light permeable base plate, a thin film EL element formed on the base plate and a moisture-proof sheet covered thereon, an improvement residing in that a moisture-absorption layer is formed on the inside surface of the moisture-proof sheet by coating powder thereon having moisture absorption properties.

U.S. Pat. No. 5,500,635

Inventor: Jonathan C. Mott

Issued: Mar. 19, 1996

A product, in particular a shoe, apparel, a ball or a fishing lure, incorporating an impact sensing element made from polymeric piezoelectric material. In response to impact, the piezoelectric material generates an electrical signal to a battery-powered light- or sound-emitting unit or to an information display device which is at least partially molded into or contained in the product, thus causing circuitry to energize the light- or sound-emitting device from the battery or to display information on the information display device. In some embodiments involving light-emitting devices such as LEDs, the light is conducted to an outside surface of the product directly through the LED or via one or more optical fibers. A shoe can be provided with numerous light-emitting devices, one or more impact sensing elements, a temperature sensor and appropriate circuitry to process the impact and temperature information. This information is then used to light appropriate light-emitting devices such as to display a bar graph of temperature or force of impact, to light or flash individual light-emitting devices or to activate an information display device. In addition, a microprocessor can be included in the circuitry to provide preprogrammed control of the light emitting devices or to evaluate the input from the impact sensing element and then light the appropriate light emitting device or devices or to control the information displayed on the information display device.

U.S. Pat. No. 5,813,148

Inventor: Rafael J. Guerra

Issued: Sep. 29, 1998

Footwear with optical fiber illuminating display areas provides emphasis on illuminating certain features of the footwear, such as trademarks, logos, team sports, cartoon characters, and other artistic designs primarily for advertising, decoration and enhancing the visibility of the wearer. Footwear with optical fiber illuminating display areas includes: an optical fiber panel(s) made visible through an opening, window, or transparent material on the sole, upper, or tongue portions of the footwear; a light emitting device(s) which transmits light into the optical fiber panel (s); components and circuits for making the light emitting device(s) and the illuminating optical fiber display areas intermittently flash, alternate flash, alternate colors, sequence in motion, activate by pressure or motion switching, activate by manual switching, or any combination thereof; and batteries for supplying power to the light emitting device and the components and circuits aforementioned. A control module combines the light emitting device (s), components and circuits, and batteries into a housing which is positioned in the heel, sole, upper, or tongue portion of the footwear, depending on the embodiment employed. Such footwear embodiments include and are not limited to athletic shoes (e.g. Tennis, Basketball, aerobic, cross trainers, walking, jogging, running), casual and formal dress shoes, roller skates, Ice skates, and Ski boots.

U.S. Pat. No. 5,865,523

Inventor: Tseng-Lu Chien

Issued: Feb. 2, 1999

An illumination arrangement for a shoe includes a D.C. power supply, a DC-AC inverter, and an electro-luminescent element which can be mounted on a surface of an upper portion of the shoe, or with a transparent area of the bottom portion of the shoe. The DC power supply and DC-AC inverter may be mounted in the bottom of the shoe.

U.S. Pat. No. 5,879,069

Inventor: Tseng-Lu Chien

Issued: Mar. 9, 1999

An illumination arrangement for a shoe includes a D.C. power supply, a DC-AC inverter, and an electro-luminescent element which can be mounted on a surface of an upper portion of the shoe, or with a transparent area of the bottom portion of the shoe. The DC power supply and DC-AC inverter may be mounted in the bottom of the shoe.

U.S. Pat. No. 5,903,103

Inventor: Melvin C. Garner

Issued: May 11, 1999

Flashing footwear includes at least one light source, e.g., an LED, located on an external surface of the footwear so as to be visible, such as the rear of the heel. A power source, such as a battery, provides sufficient power to light the light source to cause illumination in response to a switch actuated by the condition of motion of the footwear so as to change between open and closed positions. A circuit is combined with the battery and switch to form a module arranged in the heel of the footwear. This circuit directs power from the battery to the LED to cause the LED to illuminate for a period of time in response to a change of the switch from the closed position to the open position and/or to light continuously while the switch is closed.

U.S. Pat. No. 5,955,957

Inventor: Stephen Calabrese et al.

Issued: Sep. 21, 1999

This invention comprises footwear having a power source and switching mechanism mounted in the heel under padding and an electroluminescent wire mounted in a predetermined position on the footwear to provide illumination. The electroluminescent wire comprises a thin linear light source wherein light is produced by activating an electroluminescent phosphor with high alternating electric current. The phosphor is located between two electrically conductive wires, one in the core or center of the phosphor layer and one on the outside of the phosphor layer with spirals about the wire. The electroluminescent wire is connected to a control circuit for converting the battery power to alternating current. When an individual applies force to the bottom of the footwear or motion, a vibration sensitive switch activates the circuit causing the electroluminescent phosphor to become lighted. The wire may be positioned along the out sole inside and outside or along the tongue or other position on the footwear.

U.S. Pat. No. 6,112,437

Inventor: Bert Lovitt

Issued: Sep. 5, 2000

A lateral animation display is carried on a useful article, such as an item of wearing apparel or the like. In one example, a shoe is provided with an integral animated display. An array of light sources is disposed within the shoe. A corresponding array of image frames depicts a stop-action sequence, such as stop-action images of a person running. An optional array of baffles confines light from each of the light sources to a corresponding one of the image frames. The individual light sources are sequentially activated so as to sequentially illuminate the corresponding image frames and thereby present an animated display of the stop-action sequence.

U.S. Pat. No. 6,280,045 B1

Inventor: Edward J. Anteby et al.

Issued: Aug. 28, 2001

Lights on footwear are flashed after a random time delay generated when a motion responsive switch on the footwear has been closed to create an unpredictable, eye-catching light display.

U.S. Pat. No. 6,354,712 B1

Inventor: Edward J. Anteby

Issued: Mar. 12, 2002

An inertially responsive switch for use in footwear for electrically connecting a battery with a pair of lights includes and electrically conductive ball mounted in a housing for rolling movement about an upright axis along which a pair of electrical terminals are spaced apart. When the ball contacts the terminals, an electrical current from the battery passes along the terminals and the ball in order to illuminate the light.

SUMMARY OF THE PRESENT INVENTION

A primary object of the present invention is to provide footwear or clothing illuminated by one or more electroluminescent (EL) panels.

Another object of the present invention is to provide electro-luminescent clothing or footwear that is switch activated.

Still another object of the present invention is to provide electro-luminescent clothing or footwear wherein said switch may be enabled and disabled manually or in response to movement or pressure.

Yet another object of the present invention is to provide electro-luminescent clothing or footwear having a plurality of EL panels contiguous to the surface area of the shoe and randomly illuminated by a random motion switch or random pressure switch in response to actions performed by the wearer of the shoe.

Still yet another object of the present invention is to provide electro-luminescent clothing or footwear having a series of EL panels having graphic design thereon that when lit in series simulate the motion or animation thereof.

Yet another object of the present invention is to provide electro-luminescent clothing or footwear that is inexpensive to manufacture and operate.

One more object of the present invention is to provide electro-luminescent clothing or footwear that is simple to use.

Additional objects of the present invention will appear as the description proceeds.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
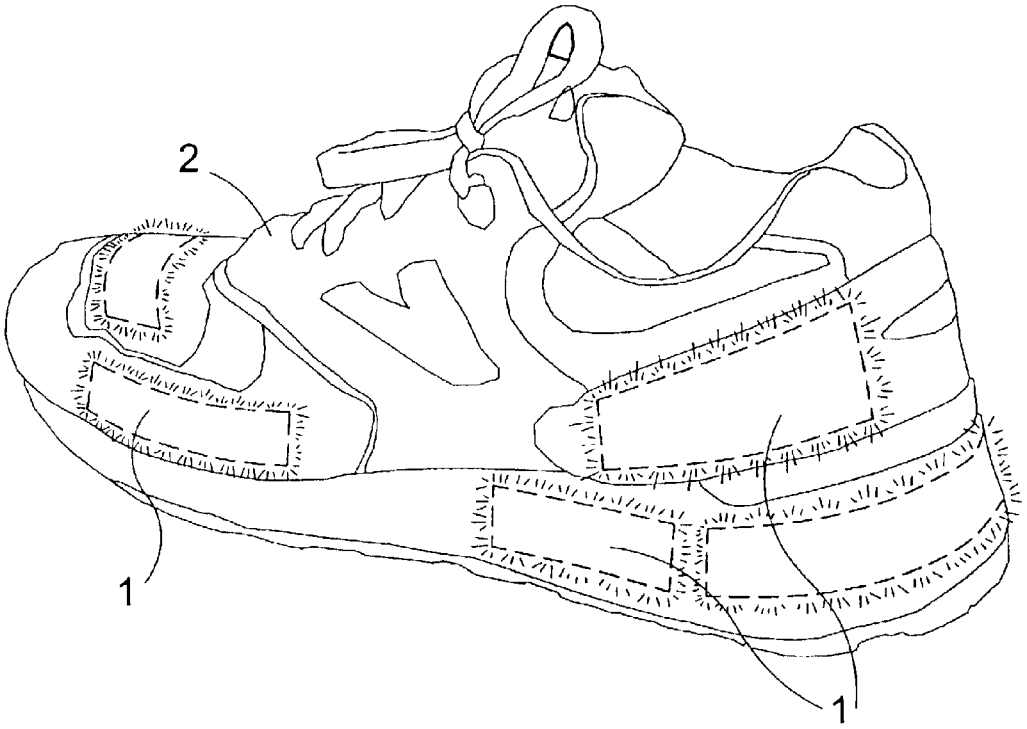
FIG. 1 is a perspective view of the present invention in use.

Turning now descriptively to the drawings, in which similar reference characters denote similar elements throughout the several views, the figures illustrate the present invention. With regard to the reference numerals used, the following numbering is used throughout the various drawing figures.

100 random pressure switch
200 random orbiter motion pressure switch
P applied pressure
C electrical contact
E electrical power out
1 EL light strip
2 wall light display
3 EL letter graphic
4 EL star graphic
5 letter graphics
6 star graphics
7A star graphic switch
7B letter graphic switch
8A EL star graphic electrodes
8B EL letter graphic electrodes
9 DC/AC converter
10 battery
11 individual EL star graphic light strips
12 individual EL star graphic electrodes
13 random pressure switch
14 power source
15 control switch
16 power-in electrode
17 conductive pressure plate
18 distribution plate
19 conductive spring
20 contact plate
21 power-out electrodes
22 insulator sleeve
23 electrical leads
24 electrical terminals
25 spring coil retainer clip
26A, 26B, 26C, 26D on/off switches
27 star sequencer
28 letter sequencer
29 individual letter graphic EL strips
30A, 30B, 30C, 30D sequencers
31 random motion switch

32, 33, 34, 35 steps of a sequencer control
36 non-conductive base plate
37 contact plate
38 spring anchor
39 power-in electrode
40 power-out electrode
41 orbiter spring
42 orbiter
43 distribution plate
43B bottom surface of distribution plate
44 bottom surface printed circuit connections
45 orbiter contact shoe
46 orbiter friction shoe
47 orbiter frame
48 orbiter contact shoe internal spring
49 supplemental LED's
50 function interpreter

DETAILED DESCRIPTION OF THE DRAWING FIGURES

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

FIG. 1 is an illustrative view of the present invention in use. The present invention utilizes electroluminescent (EL) light strips 1 for various display effects. EL light strips 1 can be used to create many different colors and shapes. In addition, various decorations and graphic elements can be glued to the surface as well as printed. In thin strip forms, EL strips 1 can be formed into various shapes and removably or fixedly attached to articles of clothing or footwear. A shoe 2 is shown having various EL light strips 1 attached.

Figure 2:
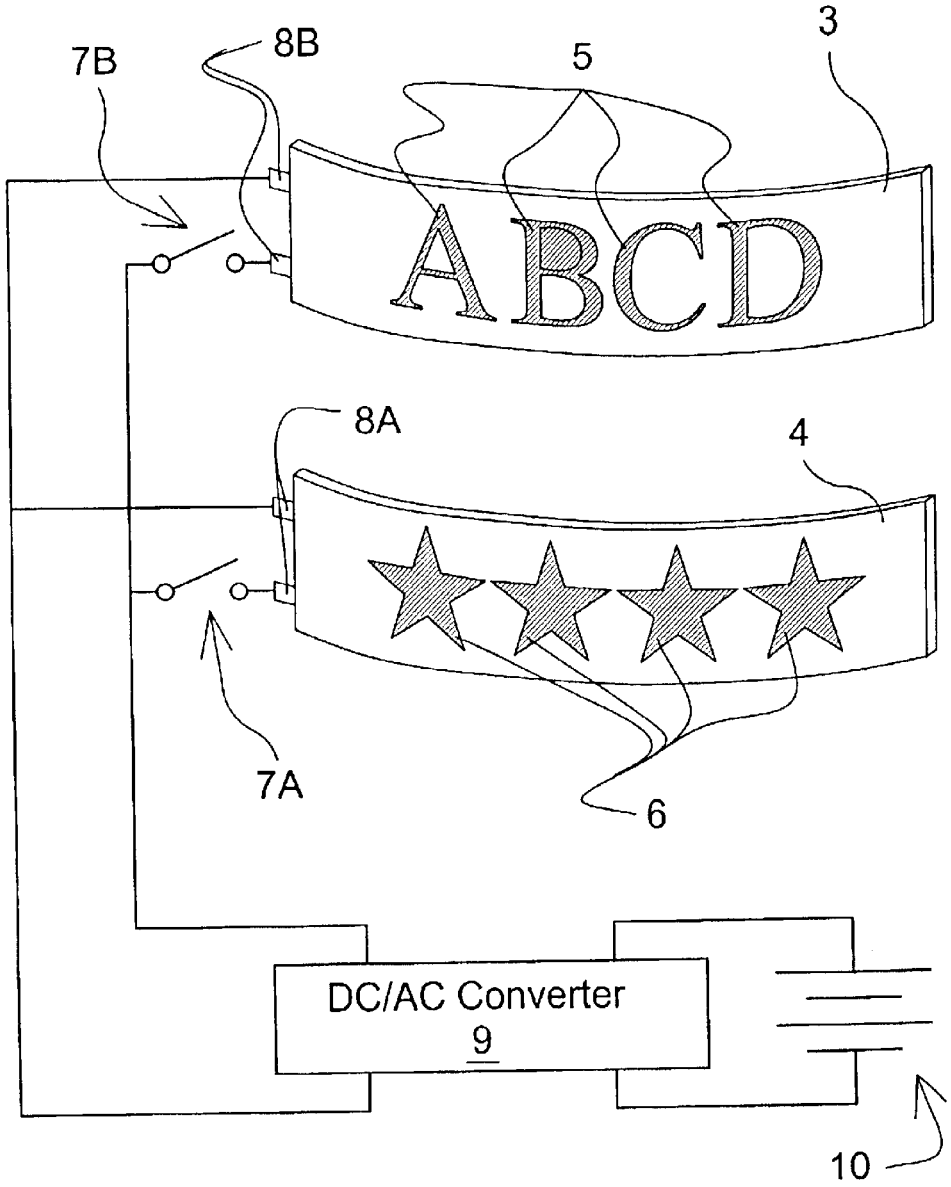
FIG. 2 is a schematic illustration of typical El strips connected to a random pressure switch.

FIG. 2 is a schematic illustration of typical El strips connected to a random pressure switch. Individual EL star graphic strip 4 and EL letter graphic 3 have various solid or textured colors and can have other shapes beside the star graphic elements 6 or the letter graphic elements 5 which are depicted. Each of the EL strips can bear any mixture of a plurality of graphic elements. EL letter graphic 3 and EL star graphic 4 each has one electrode 8A, 8B connected to one output of DC/AC converter 9 and the other respective electrode 8A, 8B connected to an input switch 7A, 7B respectively. Converting DC battery source 10 inputs to DC/AC converter 9 which amplifies input voltage and outputs the required AC current to each EL strip when switch 7A or 7B (or both) are closed.

Figure 3:
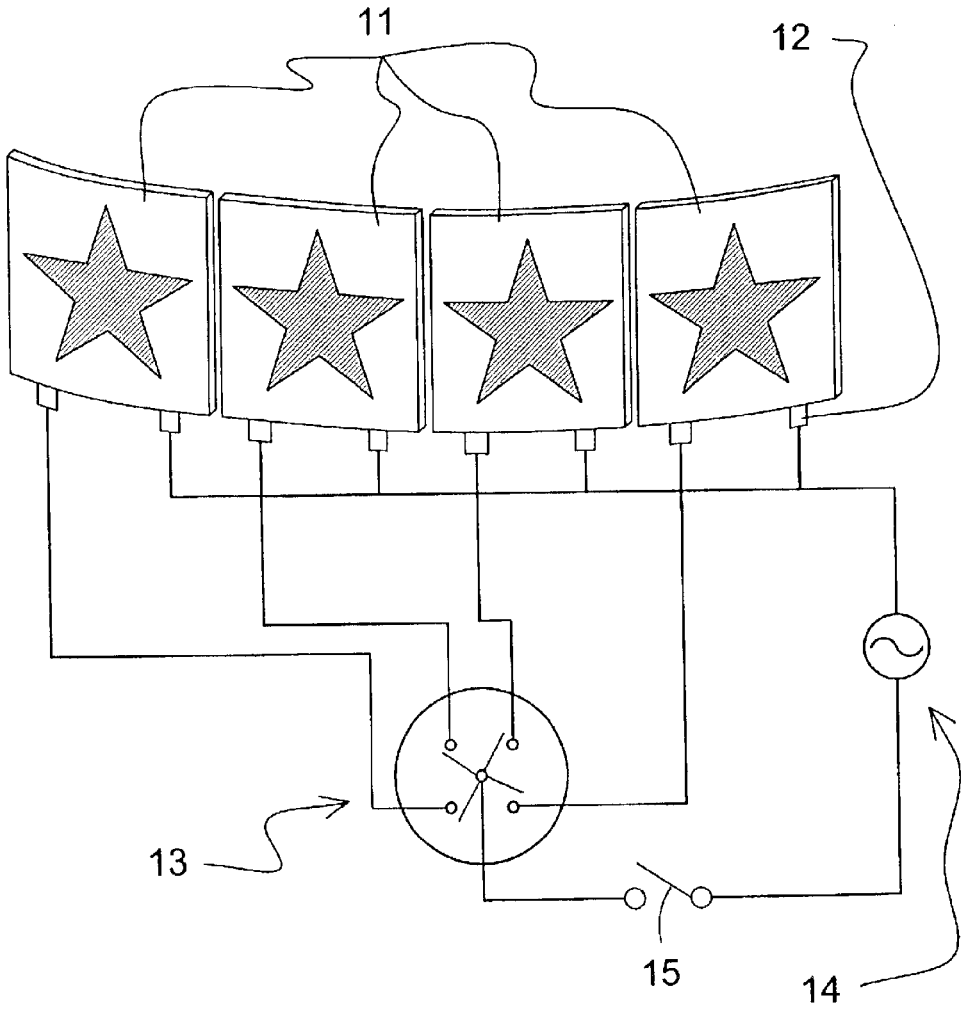
FIG. 3 is a schematic illustration of individual EL star graphic light strips of the present invention hooked to a random pressure switch.

FIG. 3 is a schematic illustration of individual EL star graphic light strips 11 of the present invention hooked to a random pressure switch 13. EL star graphic light strips 11 can be directly connected to the random pressure switch 13 thus making the lighting of EL star graphic light strips completely random. Control switch 15 can be opened to disable EL lighting effects. Random pressure switch 13 can also turn on more than one EL strip at a time for various effects. The preferred embodiment of random pressure switch 13 is to use random pressure switch 100 as described below in FIG. 4.

Figure 4:
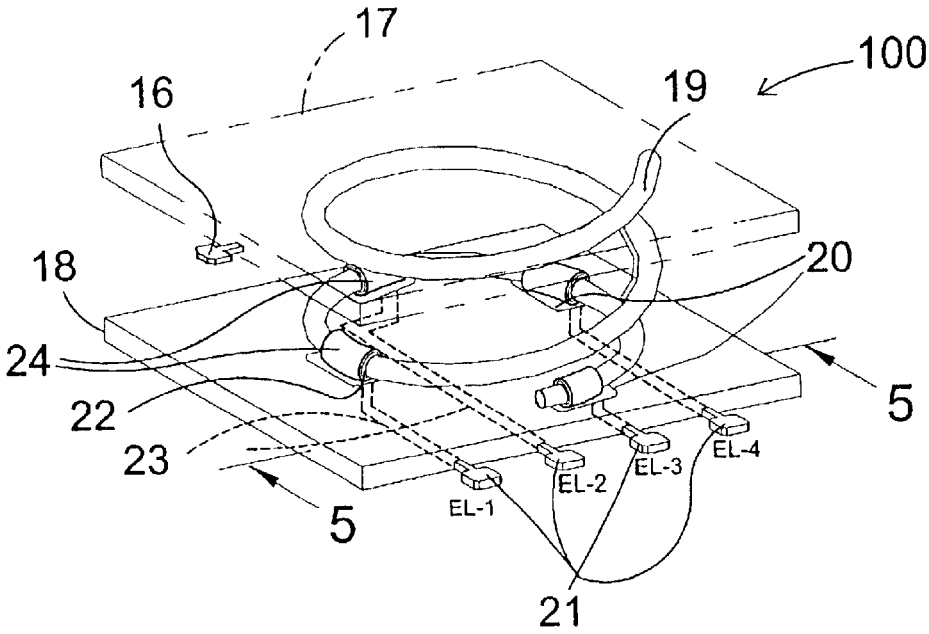
FIG. 4 is a frontal perspective view of a random pressure switch, the preferred embodiment.

FIG. 4 is a frontal perspective view of random pressure switch 100, the preferred embodiment. Random pressure switch 100 is an assembly that utilizes a conventional conductive spring 19 element that has a plurality of contact points to complete circuits to various EL strips as pressure is applied thereto during movement of the user thereby causing conductive spring 19 element to flex accordingly and illuminate the corresponding EL strip. Any appropriate spring oriented random contact switch may be used and the present invention is in no way limited to the switches illustrated in the drawing figures. Shown is a conductive spring 19 with the top portion thereof attached to a conductive pressure plate 17 and the lower portion fastened to distribution plate 18 but not in direct contact therewith due to a plurality of spaced apart, insulated sleeve members 22 and electric terminals 24 concentrically placed thereon. Electric terminals 24 are seated on contact plates 20 having electrical leads 23 communicating with power-out electrodes 21 for each respective EL strip (not shown) to be attached. Power is brought into conductive pressure plate 17 at power-in electrode 16.

Figure 5:
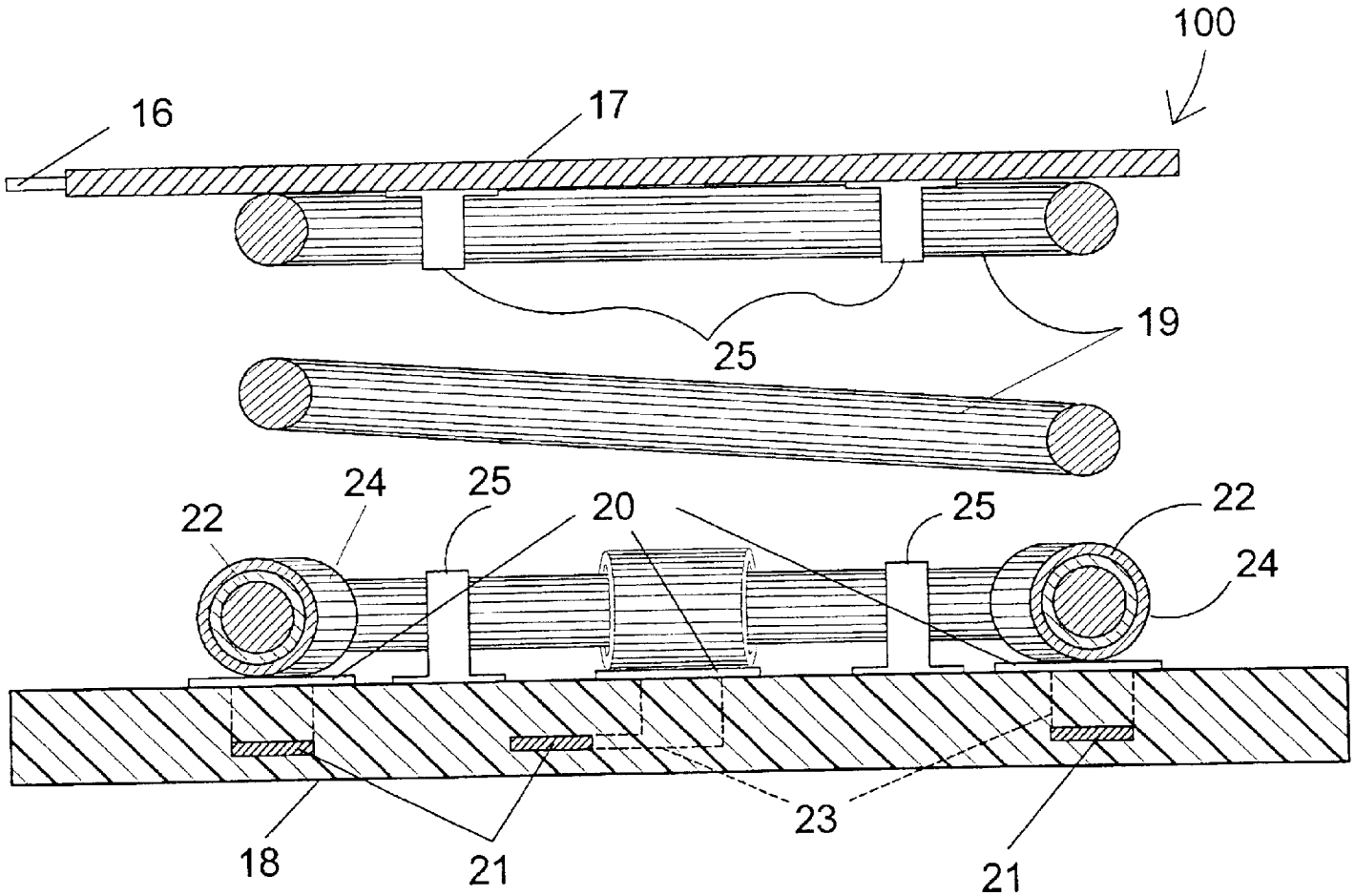
FIG. 5 is a cross sectional side view of a static random pressure switch taken from FIG. 4 as indicated.

FIG. 5 is a cross sectional side view of random pressure switch. 100 taken along plane 5—5 of FIG. 4. Shown are power-in electrode 16, which supplies power to conductive pressure plate 17. Spring coil retainer clips 25 hold conductive spring 19 into position with respect to conductive plate 17 and distribution plate 18. Insulator sleeves 22 are located between conductive spring 19 and electrical terminals 24 at each contact plate 20 functioning to isolate conductive leads 23 and power-out electrodes 21 when conductive spring 19 is in a neutral (non-pressure) position.

Figure 6:
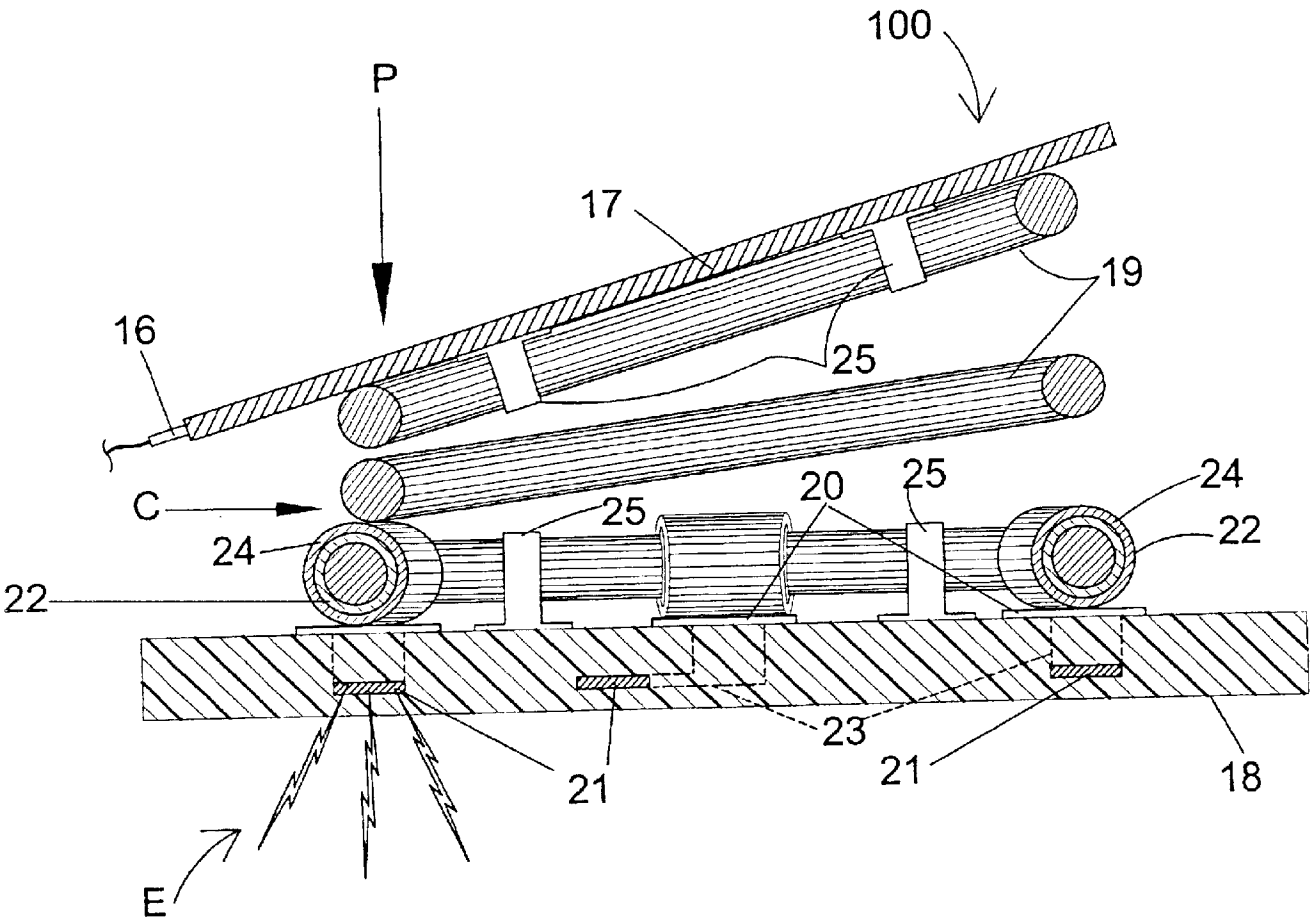
FIG. 6 is a cross sectional side view of a pressure activated random pressure switch.

FIG. 6 is a cross sectional side view of a random pressure switch 100 with pressure P applied. With pressure P applied to conductive pressure plate 17 conductive spring 19 is shown flexed (or deformed) from a non-pressure position such that electrical connection C is made between conductive spring 19 and electrical terminal 24 thus completing an electrical circuit from power-in electrode 16 to power-out electrode 21 where power E is supplied to illuminate at least one external EL light strip.

Figure 7:
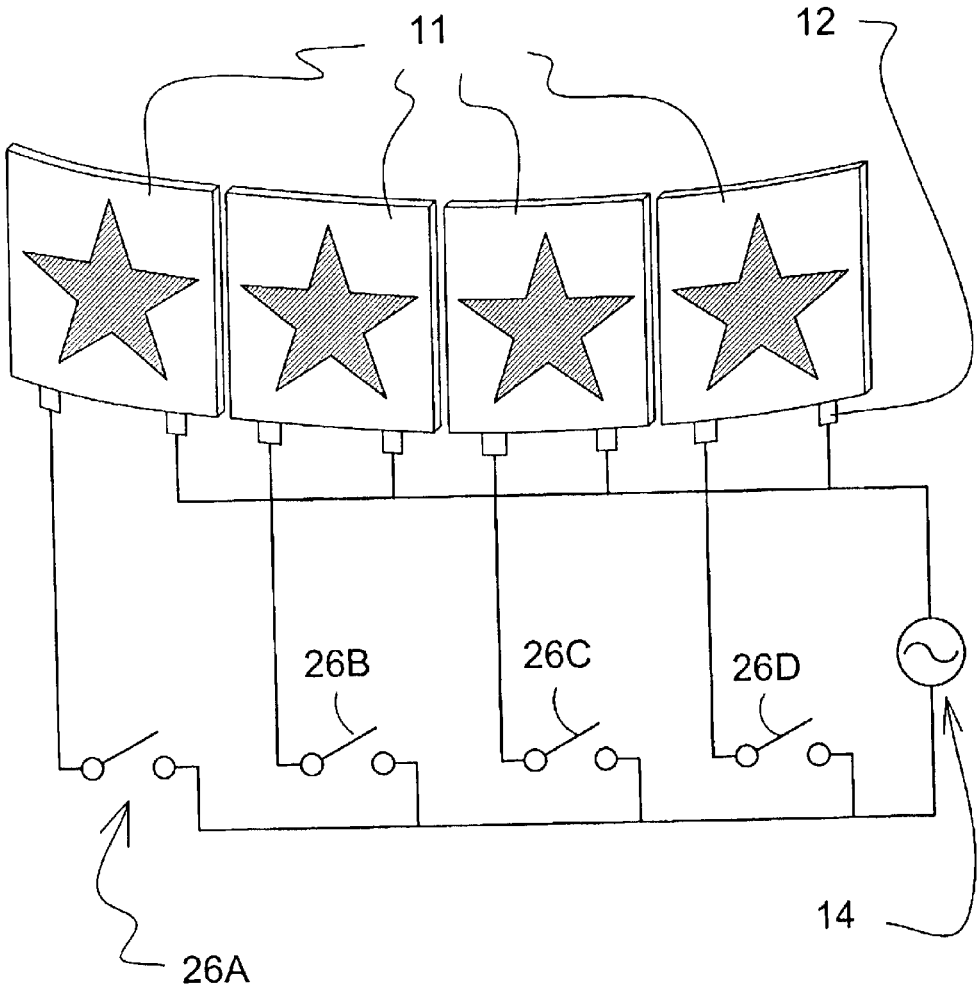
FIG. 7 is a schematic wiring diagram of a series separately switched EL strips.

FIG. 7 is a schematic wiring diagram of a separately switched series of EL strips 11. EL strips 11 can be placed contiguously and switched on and off in a series to create visual effects. This can, for example, give an illusion of movement from one graphic element to another as EL strips 11 are switched on and off. This kind of lighting sequence can be accomplished by a preset electrical sequencing circuit to activate/deactivate switches 26A, 26B, 26C, 26D which would supply, or not supply, power from power source 14 to electrodes 12 of each individual EL strip 11. Multiple sequencing circuits can be employed for various types of EL strips. Such multiple sequencing circuits, in turn, can be initiated by another sequencing circuit, or by a random event. A series of EL strips can be lighted by random events directly for different visual effects.

Figure 8:
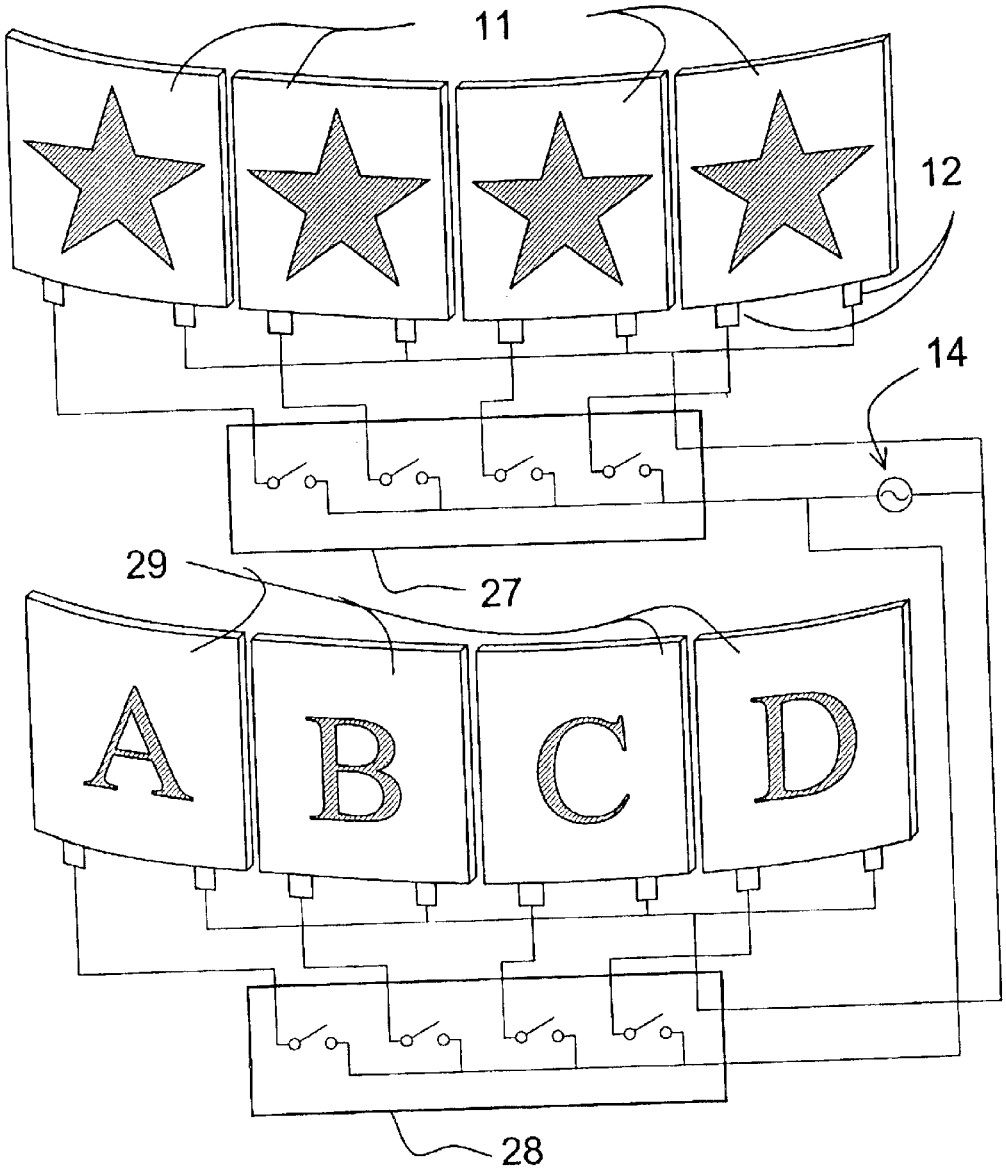
FIG. 8 is a schematic wiring diagram of the use of multiple sequencing circuits.

FIG. 8 is a schematic wiring diagram of the use of multiple sequencing circuits. A number of preset sequencing circuits (sequencers) can be employed to light a series of EL strips for visual effects. In this case, each of the sequencers will repeat a predetermined switching routine at predetermined intervals. Star sequencer 27 logically controls four individual switches going to each star graphic EL strip 11 whereas letter sequencer 28 controls four individual internal switches connecting to letter graphic EL strip 29. It should be noted that although two sequencers are shown, the schematic of FIG. 8 could easily be extended to any multiple of sequencers and any multiple of EL elements. However, in certain instances, such flash patterns may quickly become routine and boring. The present invention overcomes this type of shortcoming by introducing randomness and responsiveness based on the movement of a wearer, which will be shown below.

Figure 9:
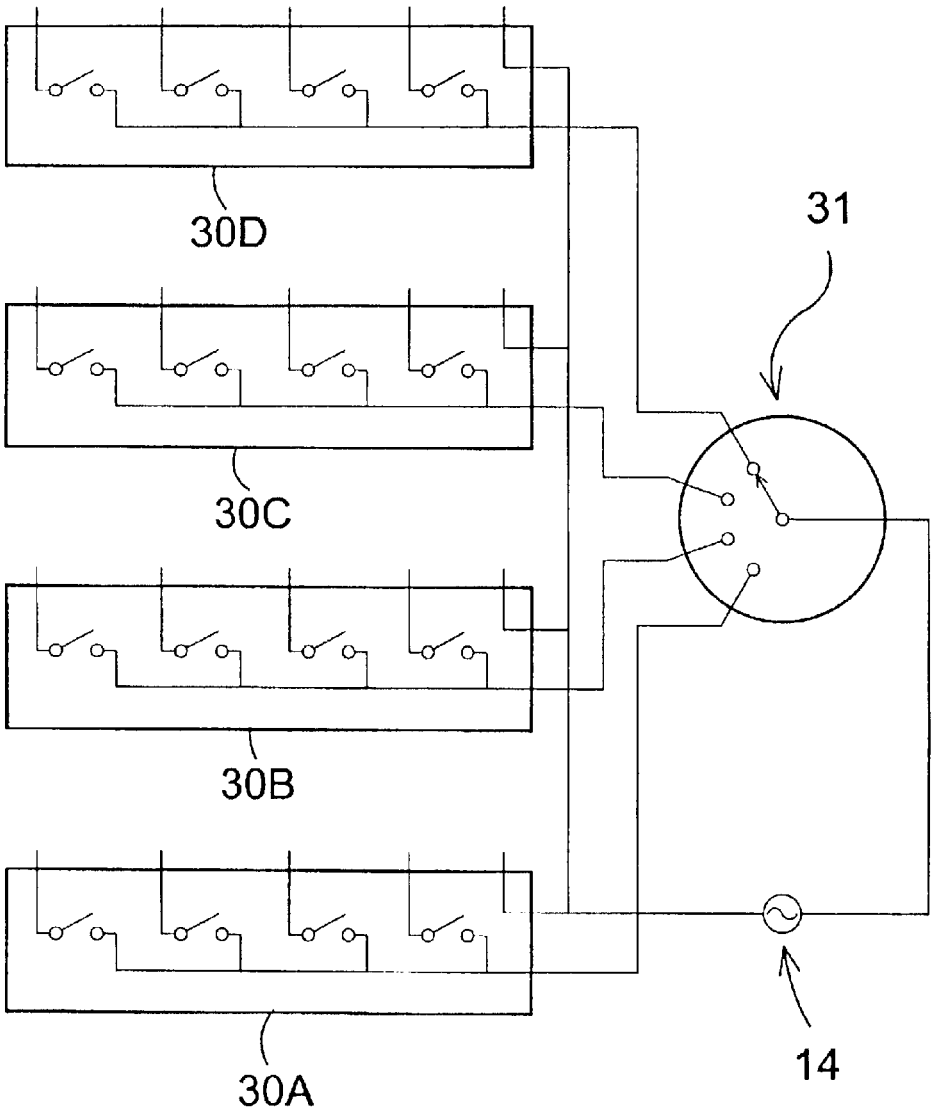
FIG. 9 is a schematic wiring diagram of a use of the present invention with random control of switching sequencers.

FIG. 9 is a schematic wiring diagram of a use of the present invention with random control of switching sequencers 30A, 30B, 30C, and 30D. The group of sequencers 30A, 30B, 30C, 30D can be each initiated randomly by random motion switch 31 to start a series of predetermined switching routines bringing power 14 to EL strips via sequencer outputs instead of repeating such routines endlessly. Once a routine is finished, the respective sequencer will be ready to be initiated again by the random motion switch 31. This gives indefinite variety of unexpected and responsive visual effects based on the user's motion. It should be noted that although four sequencers are shown, each with four internal switches, any multiple of sequencers can be used with each sequencer controlling any multiple of internal switches.

Figure 10:
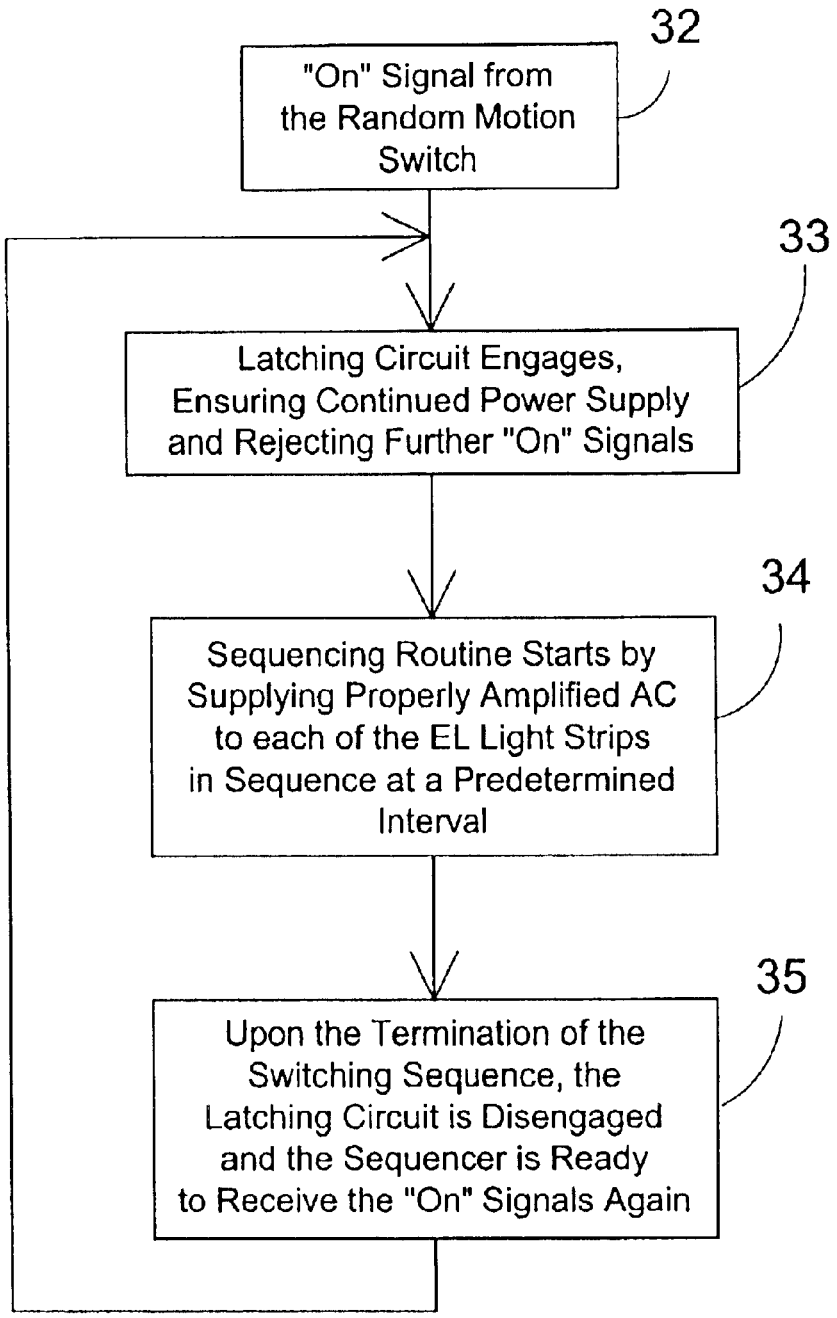
FIG. 10 is a block diagram of the function of a sequencer circuit.

FIG. 10 is a block diagram of the function of a sequencer circuit. A sequencer turns a series of pre-assigned EL strips on and off in sequence by supplying proper ac voltage to each of the EL strips selectively. In step 32 an "on" signal is received by a sequencer from a random motion switch. In step 33, while a sequencer is engaged in the switching routine, a latching circuit holds the sequencer's power supplied in an active state while blocking out any further "on" signals from the random motion switch. In step 34, the sequencing routine starts by supplying properly amplified AC current to each of the EL light strips in sequence and at a predetermined time interval. In step 35, the latching operation is disengaged at the end of the sequencing routine at which time the sequencer is ready to receive another "on" signal from the random motion switch.

Figure 11:
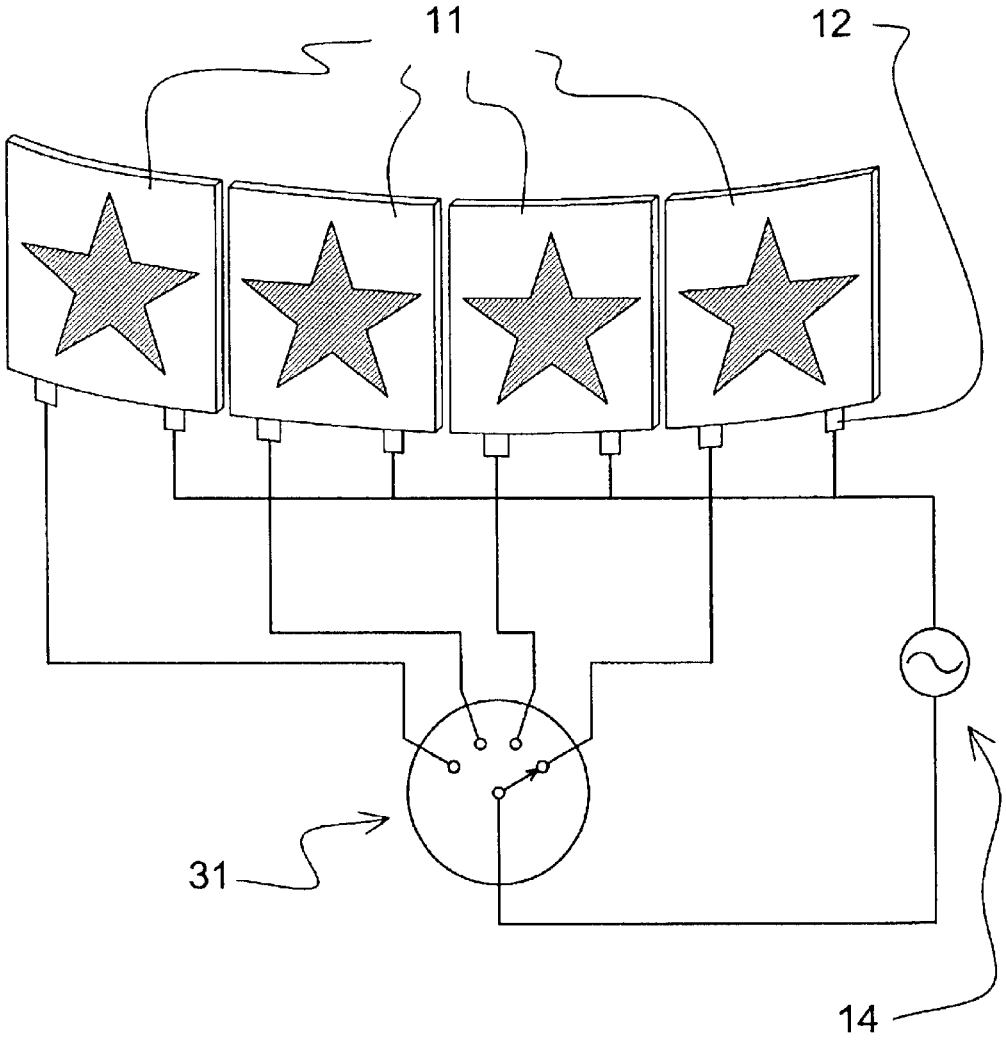
FIG. 11 is an illustration of an alternative use of the random motion switch.

FIG. 11 is an illustration of an alternative use of random motion switch 31. Individual EL star graphic light strips 11 are depicted directly connected to random. motion switch 31 without the use of the intermediate sequencers. This makes the lighting of the EL strips completely random. Random motion switch 31 can be configured to send power source 14 voltages in serial fashion, thereby creating the illusion of motion. Random motion switch 31 can also be configured to turn on more than one EL strip at once for various other effects. Random motion switch connects power source to one electrode 12 of EL star graphic light strip while the other electrode 12 is directly connected to power source 14. It should be noted that although random motion switch 31 is shown with four outputs feeding four EL light strips, the design can easily be expanded to any multiple of random motion switch outputs (or multiple of random motion switches) and EL light strips.

Figure 12:
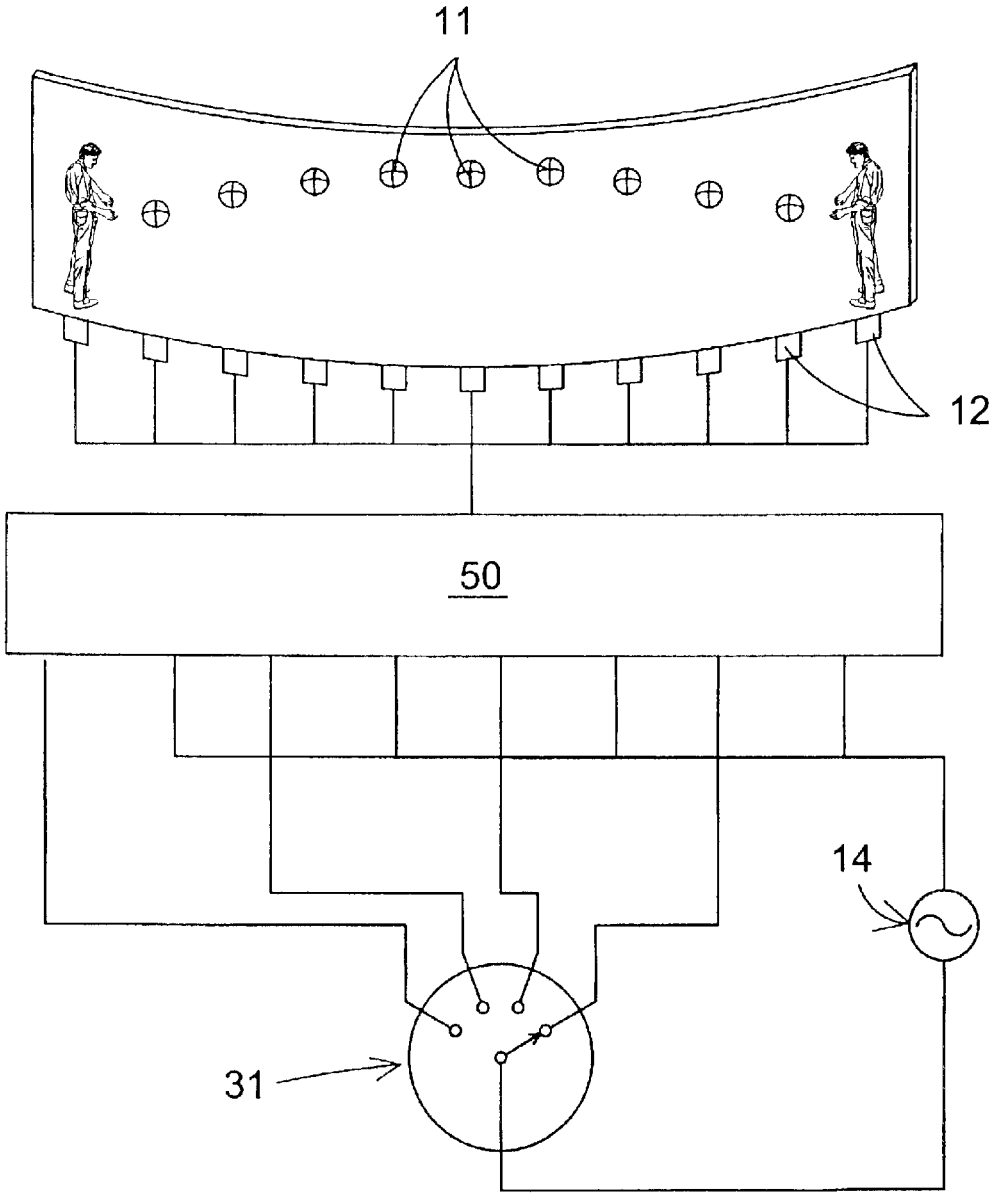
FIG. 12 is an illustration of another alternative use of the random motion switch.

FIG. 12 is an illustration of another alternate use of random motion switch 31 wherein switch 31 is connected to function interpreter 50 that energizes a series of predetermined switching routines bringing power 14 to EL strips via sequencer outputs. The function interpreter 50 provides power source 14 to a series of electrodes 12 of EL graphic light strip. Each of the four random contacts of switch 31 signals the function interpreter 50, based on the predetermined signal of each contact received, the function interpreter 50 will illuminate the artwork 11 in sequence in a predetermined direction, thereby giving the appearance of animation motion in various flash directions. As illustrated, the artwork 11 would appear that two people were playing catch. Once a routine is finished, the function interpreter 50 would be ready to be initiated again by the random motion switch 31.

Figure 13:
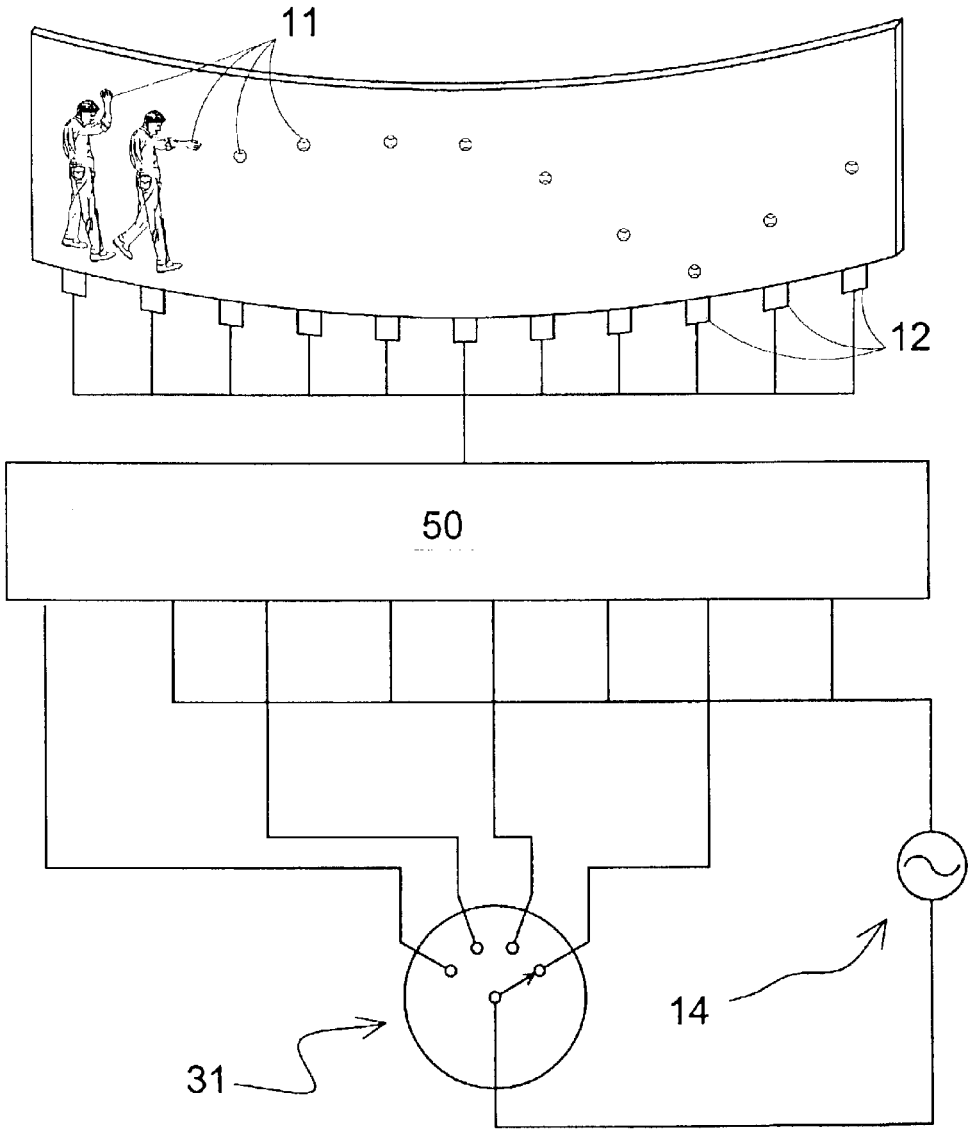
FIG. 13 is an illustration of another alternative use of the random motion switch.

FIG. 13 is an illustration of another alternate use of random motion switch 31 wherein switch 31 is connected to function interpreter 50 that energizes a series of predetermined switching routines bringing power 14 to EL strips via sequencer outputs. The function interpreter 50 provides power source 14 to a series of electrodes 12 of EL graphic light strip. Each of the four random contacts of switch 31 signals the function interpreter 50, based on the predetermined signal of each contact received, the function interpreter 50 will illuminate the artwork 11 in sequence in a predetermined direction, thereby giving the appearance of animation motion in various speeds. As illustrated, the artwork 11 would appear that a person is moving and throwing a ball. Once a routine is finished, the function interpreter 50 would be ready to be initiated again by the random motion switch 31.

Figure 14:
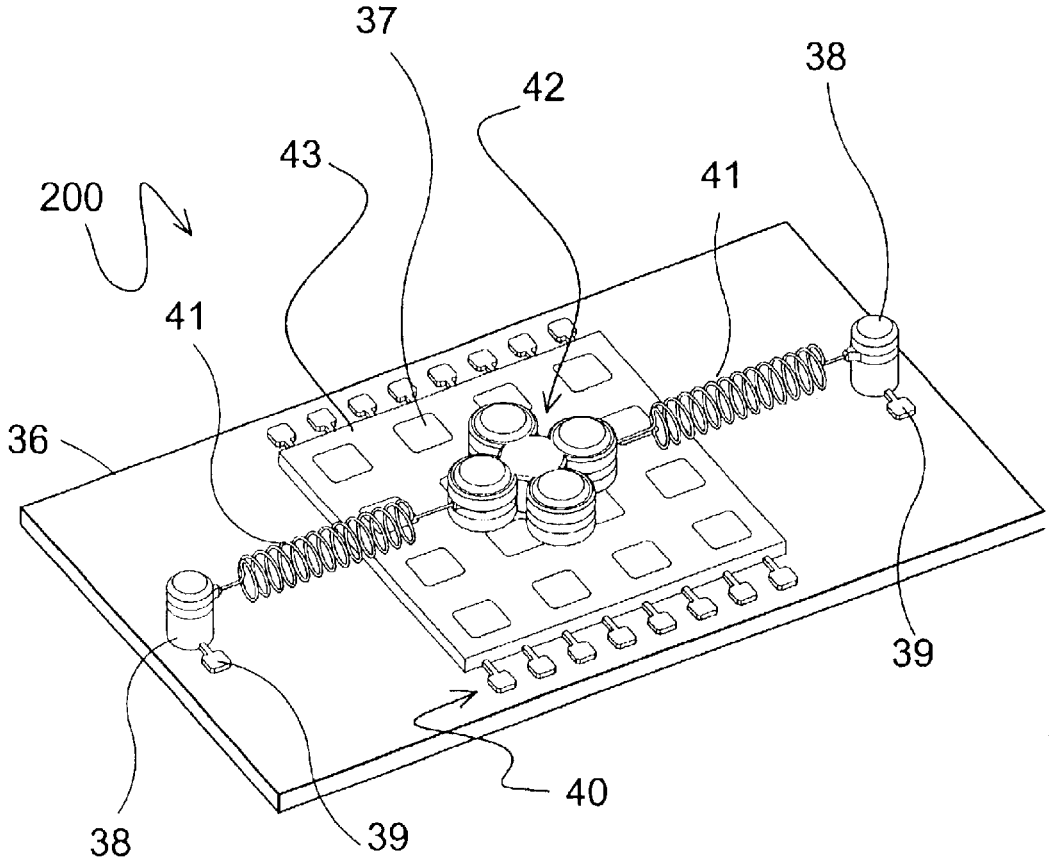
FIG. 14 is a perspective view of a random orbiter motion pressure switch.

FIG. 14 is a perspective view of a random orbiter motion pressure switch 200. Shown is a demonstrator of a random orbiter motion pressure switch. Power is brought into random orbiter motion pressure switch 200 at each of two power-in electrode 39 points which are, in turn, connected to each of two spring anchors 38 located on each side of non-conductive base plate 36. Power continues to each of two orbiter springs 41 which are, in turn, electrically connected to orbiter 42. At the bottom (not shown) of orbiter 42 is a spring-loaded contact electrode (orbiter contact shoe), which is in constant contact with one of a multiple of distribution plates 37. Distribution plates 37 each extend through non-conductive base plate 36 and are connected via conductor lines to respective power-out electrodes 39. Thus at least one power-out electrode is activated depending on the position of orbiter 42. Orbiter 42 is basically an electrically conductive weight, which is constrained by a number of springs 41 which constrain orbiter 42 to move about on distribution plate 43 as motion is applied to random orbiter motion pressure switch 200. This motion of the orbiter 42 results in random contacts between contact plates 37 on distribution plate 43 and orbiter 42 by way of the orbiter contact shoe, which can be seen below in FIG. 15, thereby closing the circuit between the power-in electrodes 39 and the power-out electrodes 40 which are connected to an EL light strip (or a sequencer). Thus, full electrical conduction is maintained between power-in electrodes 39, orbiter 42 through orbiter contact shoe and power-out electrodes 40. It should be noted that random orbiter motion pressure switch 200 can easily be applied to clothing as to footwear as simple motion activates the movement of the switch position. It should be noted that non-conductive base plate 36 and distribution plate 43 could be manufactured as one entity using available circuit card technology. Random orbiter motion pressure switch 200 in conjunction with a power source and EL's, can be easily packaged to an article of footwear, clothing, back pack, bicycle frame or any variety of objects that are set into motion.

Figure 15:
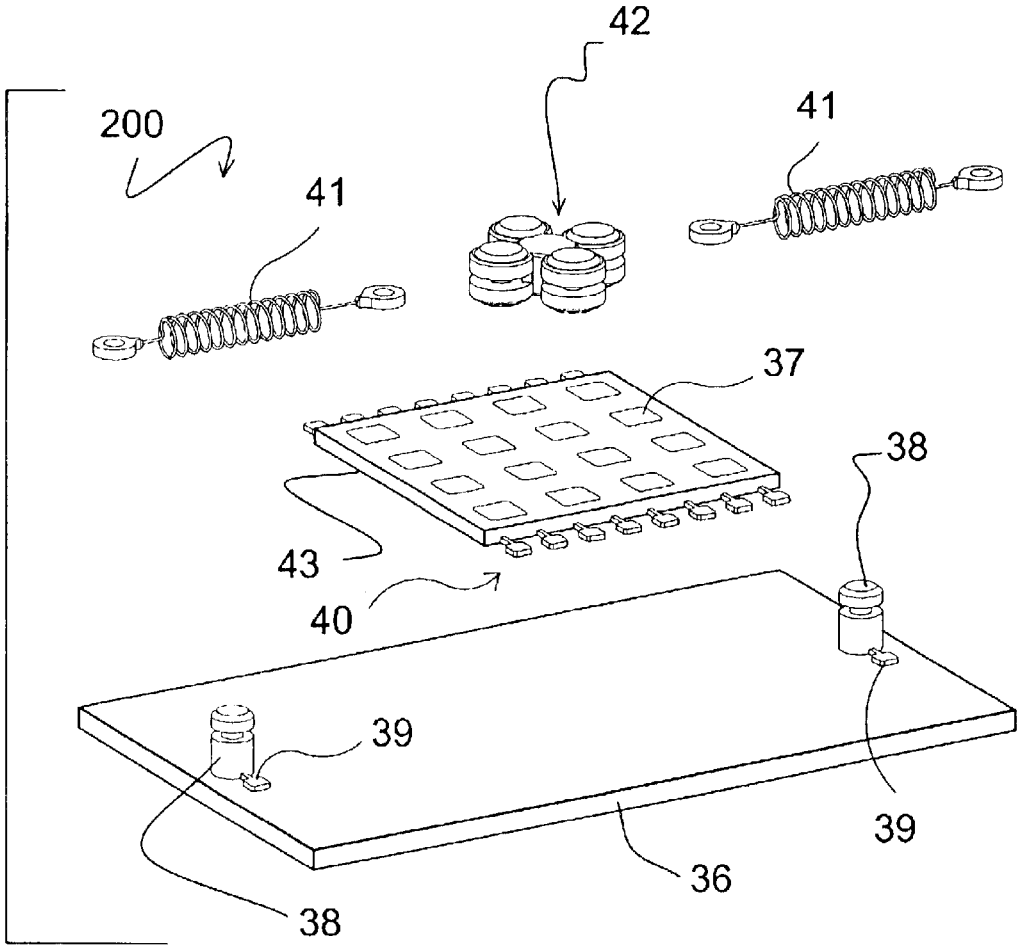
FIG. 15 is an exploded view of another random orbiter motion pressure switch.

FIG. 15 is an exploded view of random orbiter motion pressure switch 200. Two main components are orbiter 42 and distribution plate 43. The base plate provides the area on which these elements are assembled. The whole orbiter motion pressure switch 200 could be encased in a housing. Such a housing (not shown) would contain the top surface of orbiter 42 and prevent orbiter 42 from bouncing off the surface of distribution plate 43. Shown are base plate 36, which contains spring anchors 38 and power-in electrodes 39. Distribution plate 43 contains contact plates 37 and power-out electrodes 40. Orbiter springs 41 connect to spring anchors 38 at one end and to orbiter 42 at the other end and constrain movement of orbiter 42 over distribution plate 43.

Figure 16:
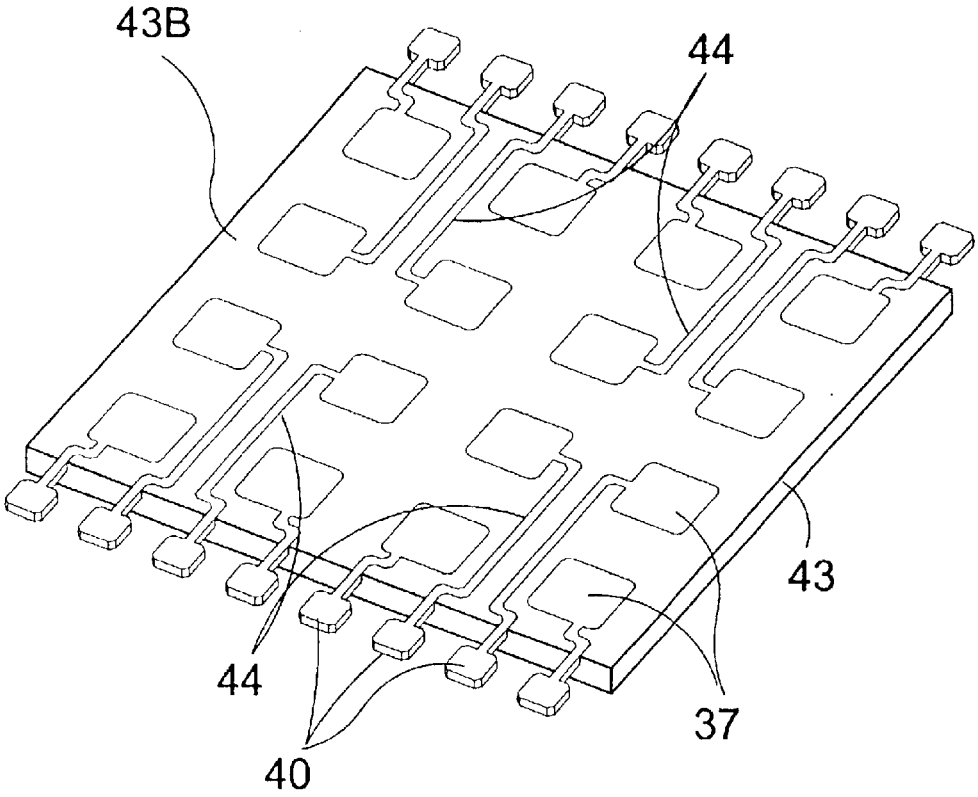
FIG. 16 is a bottom perspective view of the distribution plate.

FIG. 16 is a bottom perspective view of distribution plate 43. The bottom view of distribution plate 43 shows that every contact plate 37 extends through distribution plate 43 to distribution plate bottom surface 43 and are connected to a power-out electrode 40 via surface printed circuit connections 44. Each of the power-out electrodes 40 can be connected to an EL light strip of a group for which the particular random motion switch is assigned. Alternatively, each one of the power-out electrodes 40 can be connected to a sequencer, which is, in turn, connected to a group of EL light strips.

Figure 17:
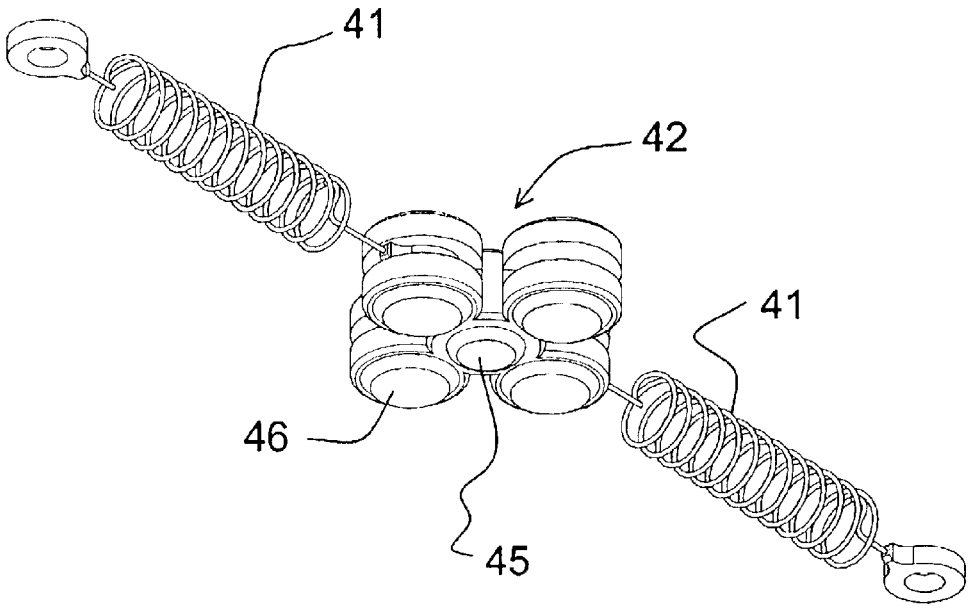
FIG. 17 is a lower front perspective view of the orbiter assembly.

FIG. 17 is a lower front perspective view of orbiter 42 assembly. Orbiter contact shoe 45 is an electrode that is spring loaded (see FIG. 16) to make contact with the contact plates 37 (not shown) on distribution plate 43 (not shown). The spring load ensures fill electrical conduction when these electrodes (orbiter 42 and contact plate 37) come into physical contact. The force of the internal orbiter contact shoe spring (see FIG. 16) on orbiter contact shoe 45 is small enough that it will not hinder the free movement of orbiter 42 itself. Orbiter 42 is supported and constrained by friction shoes 46 at the bottom as well as at the top. Friction shoes 46 are typically made of non-conductive materials that reduce the friction and provide wearabilty. If friction shoes 46 were made of conductive material, then orbiter 42 would contact more contact plates and would simultaneously power more EL's.

Figure 18:
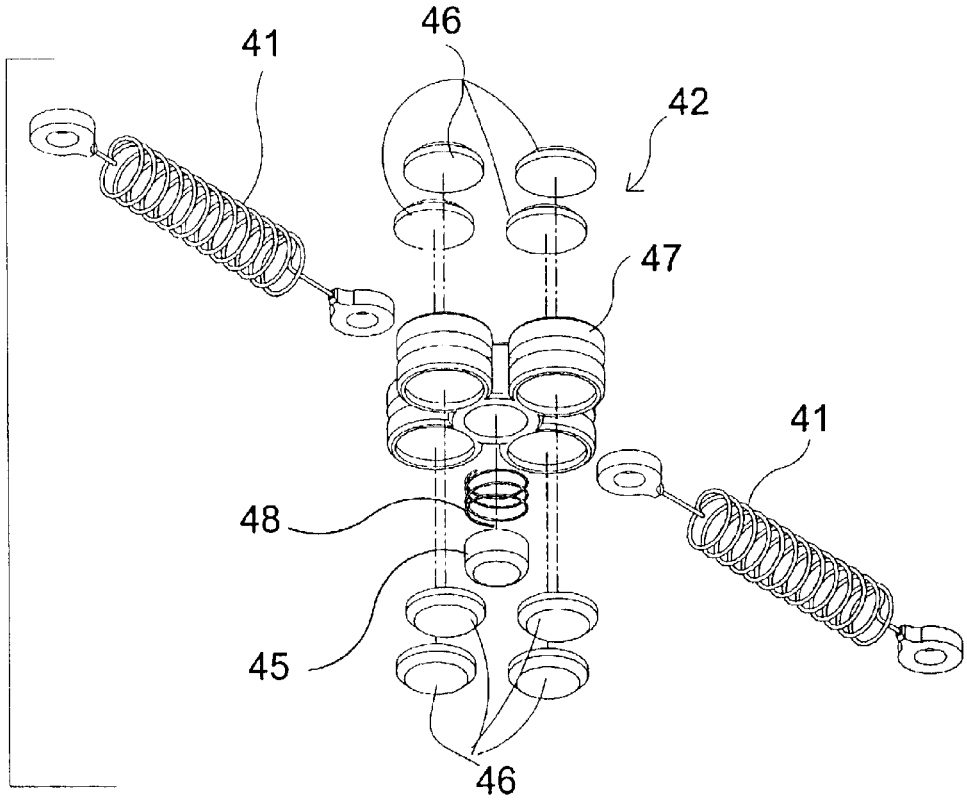
FIG. 18 is an exploded view of the orbiter assembly.

FIG. 18 is an exploded view of the orbiter 42 assembly. Orbiter 42 assembly consists of four upper friction shoes 46 and four lower friction shows 46, which are all attached to orbiter frame 47. Orbiter contact shoe is housed within orbiter frame 47 and spring loaded via orbiter contact shoe internal spring 48. Orbiter contact shoe internal spring 48 ensures maximum conduction when orbiter contact shoe 45 makes physical contact with the contact plates 37 (not shown) on distribution plate 43 (not shown). Orbiter springs 41 are pivotally engaged to orbiter 42, allowing orbiter's free movement within the distribution plate. The four upper orbiter contact shoes 46 would engage to the lower surface of an encased housing (not shown) and prevent orbiter 42 from bouncing off the surface of distribution plate 43.

Figure 19:
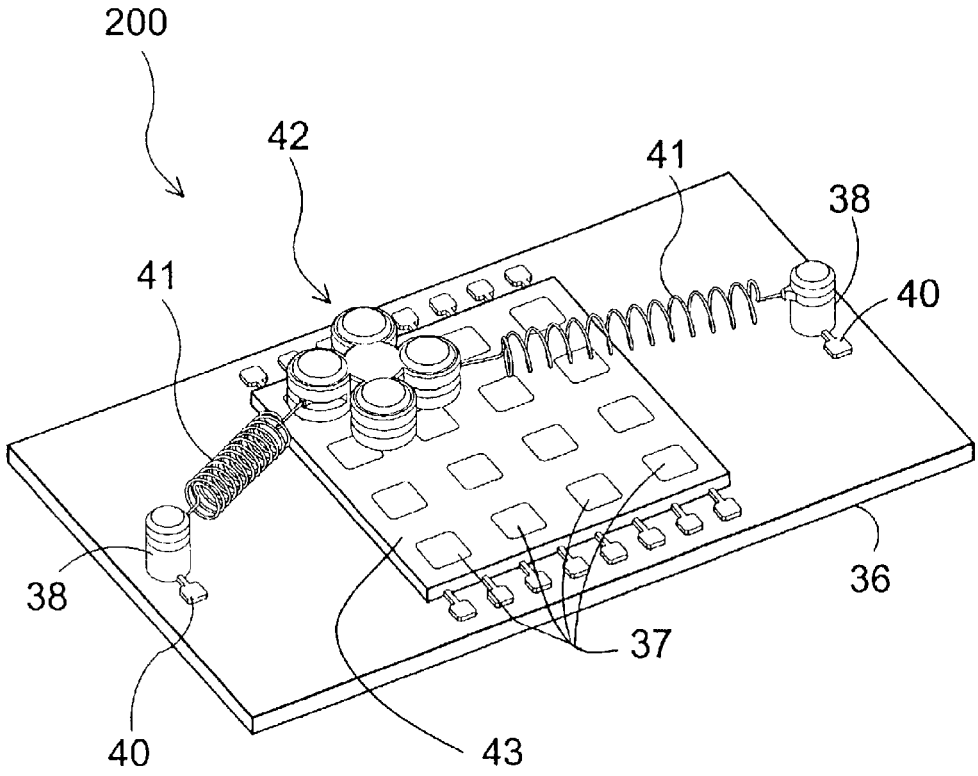
FIG. 19 is a perspective view of a random orbiter motion pressure switch in operation.

FIG. 19 is a perspective view of orbiter motion pressure switch 200 in operation. The illustration shows orbiter 42 in movement to a non-central position on distribution plate 43. Orbiter springs 41 provide restoring forces, urging orbiter 42 toward the center of distribution plate 43. As orbiter 42 picks up momentum from the movement of a wearer, the combined kinetic and potential energy keeps orbiter 42 in constant motion about distribution plate 43. The random motion switch can be configured in a variety of ways. For example, orbiter 42 might be constrained within the area of distribution plate 43 without the use of orbiter springs 41. Orbiter 42 can also be constrained to move along a linear distribution plate for a linear sequencing. Orbiter 42 might also be constrained to pivot around a point. The orbiter contact shoe can have various sizes so that it can make simultaneous multiple contacts with any number of contact plates 37 on distribution plate 43.

Figure 20:
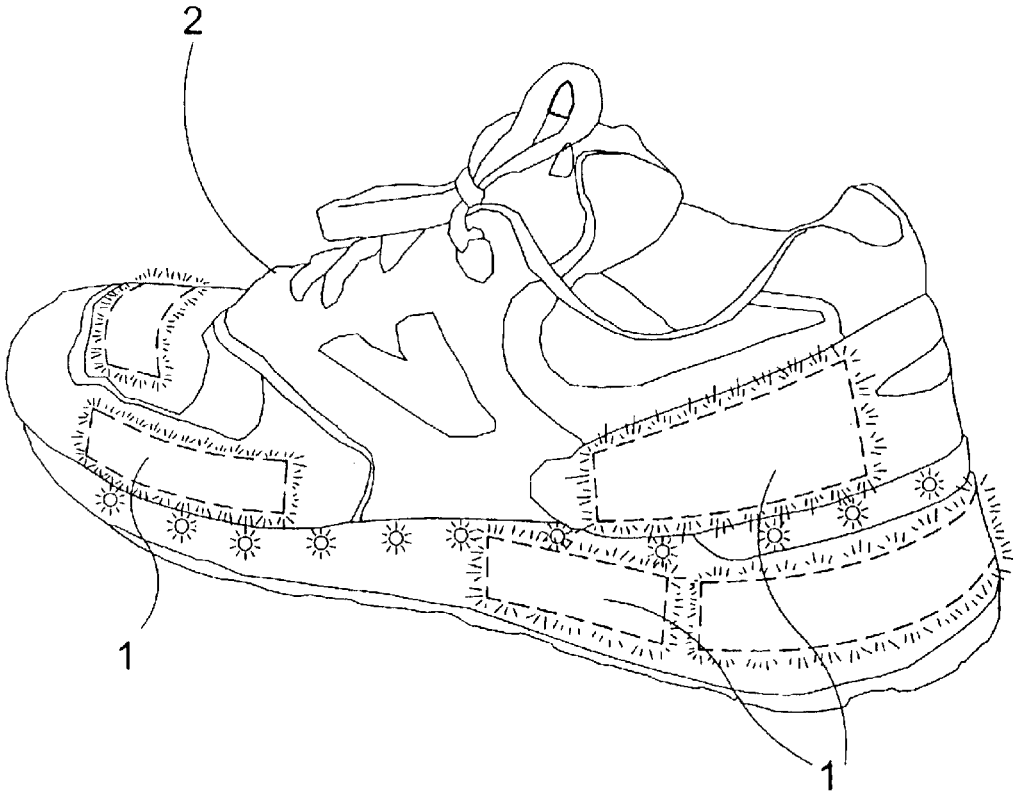
FIG. 20 is a perspective view of the electro-luminescent shoe with supplemental LED's.

FIG. 20 is perspective view of the electro-luminescent shoe with supplemental LED's lighting elements 49. The present invention can utilize EL light strips 1 in conjunction with LED lighting elements 49 for various display effects. The EL light strips and LED's can be used to create many different colors and shapes. The present invention may incorporate any combination of EL and LED lighting elements along with one or more of the switching elements.

I claim:

1. A light display for footwear, said light display comprising:

an electro-luminescent (EL) light strip having a mount to a surface of a footwear article;

an electronic circuit having a mount in the footwear article;

said electronic circuit having a battery to power the EL light strip;

a pressure switch assembly having a conductive plate and a non-conductive plate;

a conductive coiled spring connected between the conductive and non-conductive plates;

said spring having an insulated section adjacent the non-conductive plate;

said insulated section having an outer conductive sleeve which contacts a contact plate mounted to the non-conductive plate;

wherein the coiled spring is insulated from the non-conductive plate;

a central coil of the coiled spring having a conductive surface which contacts the outer conductive sleeve under a pressure between the conductive and the non-conductive plates, thereby completing a circuit from the conductive plate, through the coiled spring, through the outer conductive sleeve to the contact plate; and wherein the pressure switch powers the electronic circuit as a user steps on the footwear article.

2. The light display of claim 1 further comprising multiple insulated sections each having an outer conductive sleeve, wherein each outer conductive sleeve contacts a separate contact plate, each wired to a function interpreter that based on the predetermined signal of each contact will vary the speed of the illuminating sequence for the EL light strip providing the appearance of animated motion.

3. The light display of claim 1 further comprising multiple insulated sections each having an outer conductive sleeve, wherein each outer conductive sleeve contacts a separate contact plate, each wired to a function interpreter that based on the predetermined signal of each contact will vary the direction of the illuminating sequence for the EL light strip providing the appearance of animated motion.

4. The light display of claim 1 further comprising multiple insulated sections each having an outer conductive sleeve, wherein each outer conductive sleeve contacts a separate contact plate, each wired to a separate EL light strip, thereby providing a random switch for closing a circuit based on a random weighting of the user on the plates.

5. The light display of claim 4, wherein the number of outer conductive sleeves is four.

6. The light display of claim 4, wherein the non-conductive plate is a lower plate.

7. The light display of claim 1 further comprising a spring coil retainer clip for connecting the conductive coiled spring to the conductive and to the non-conductive plates.

* * * * *